US005672310A

United States Patent [19]

Watanabe

[11] Patent Number: 5,672,310

[45] Date of Patent: Sep. 30, 1997

[54] METHOD OF MANUFACTURING WOOD-CEMENT BOARD

[75] Inventor: Masaru Watanabe, Chikusa-ku, Japan

[73] Assignee: Nichiha Corporation, Nagoya, Japan

[21] Appl. No.: 565,109

[22] Filed: Nov. 30, 1995

[30] Foreign Application Priority Data

Oct. 23, 1995 [JP] Japan ..... 7-274195

[51] Int. Cl.[6] ..... B28B 3/00

[52] U.S. Cl. ..... 264/297.4; 264/297.9; 264/333; 264/DIG. 43

[58] Field of Search ..... 264/109, 112, 264/113, 119, 297.4, 297.6, 297.7, 297.8, 297.9, 333, DIG. 43

[56] References Cited

U.S. PATENT DOCUMENTS

| | | | |
|---|---|---|---|
| 1,168,492 | 1/1916 | Freund | 264/297.4 |
| 1,657,566 | 1/1928 | Crozier | 264/297.4 |
| 1,859,878 | 5/1932 | Lockwood | 264/297.4 |
| 1,931,018 | 10/1933 | Calkins | 264/297.4 |
| 3,201,845 | 8/1965 | Strong | 264/297.4 |
| 3,542,629 | 11/1970 | Burkner | 264/122 |
| 4,287,144 | 9/1981 | Lerebourg | 264/297.4 |
| 4,468,361 | 8/1984 | Exner et al. | 264/119 |

FOREIGN PATENT DOCUMENTS 59-34500 8/1984 Japan .

*Primary Examiner*—David A. Simmons
*Assistant Examiner*—Kenneth M. Jones
*Attorney, Agent, or Firm*—Donald S. Dowden

[57] ABSTRACT

A method of manufacturing wood-cement board and an apparatus used in the method are provided in the present invention. The method of manufacturing wood-cement board comprising strewing a raw materials mixture of wood-cement board on a mold panel to form a mat, piling up a plural number of the mats with the mold panels, pre-pressing the piled mats to reduce the thickness of each mat, piling up a plural number of the pre-pressed mat, main-pressing the pre-pressed and piled mats and curing the piled mats being main-pressed and the apparatus used in the method consists of a piling up machine piling up a plural number of mats formed on a mold panel, a pre-press machine pre-pressing the piled mats to reduce the thickness of each mat, a main-piling up machine piling up a plural number of the pre-pressed mats, a main-pressing machine main-pressing the pre-pressed and piled mats, and a curing chamber curing the piled mats being main-pressed. In the present invention, since a plural number of mats are piled up before pre-press process, the pressure effecting on the piled mats can be released slowly to prevent the generation of big negative pressure between mats without delaying pre-press process.

4 Claims, 5 Drawing Sheets

METHOD OF MANUFACTURING WOOD-CEMENT BOARD

THE FIELD OF THE INVENTION

The present invention relates to a method of manufacturing wood-cement board and an apparatus used in said method.

More particularly, the present invention relates to a method of manufacturing wood-cement board comprising strewing a raw materials mixture of wood-cement board on a mold panel to form a mat, piling up a plural number of said mats with said mold panels, pre-pressing said piled mats to reduce the thickness of each mat, piling up a plural number of said pre-pressed mats, main-pressing said piled and pre-pressed mats, and curing said piled mats with main-pressing.

Further the present invention relates to an apparatus used in said method consisting of a piling up machine piling up a plural number of mats formed on a mold panel, a pre-press machine pre-pressing said piled mats to reduce the thickness of each mat, a main piling up machine piling up a plural number of said pre-pressed mats, a main-pressing machine main-pressing said pre-pressed and piled mats, and a curing chamber curing said piled mats being main-pressed.

DESCRIPTION OF THE PRIOR ART

Hitherto, wood-cement board used as a building board such as siding and the like has been manufactured by a method comprising strewing a raw materials mixture of cement-wood board on a mold panel to form a mat, pre-pressing each mat to reduce the thickness, piling up a plural number of said pre-pressed mats with mold panels, main-pressing said pre-pressed and piled mats, and curing said piled mats with main-pressing. In said traditional method, since scores of mats are piled in the main-press process, the pre-press process should be quickly proceeded corresponding to the main-press process. The pre-press process is carried out by pressing each mat between an upper plate and a lower plate of a pre-press machine. To proceed said pre-press process quickly, the pressure effected to said mat between said upper plate and said lower plate should be released quickly. Nevertheless, when the pressure is released quickly, the negative pressure between said mat and said upper plate becomes big and the raw materials mixture on the upper surface of said mat are sucked by said big negative pressure to raise a cloud of the raw materials mixture resulting in unevenness in the upper surface of said mat. Said unevenness in the upper surface of said mat may result in not clear embossing pattern in the upper surface and non-uniformity of the density of the product.

SUMMARY OF THE INVENTION

Accordingly an object of the present invention is to elevate the efficiency of the pre-press process corresponding to the main-press process.

Another object of the present invention is to provide a wood-cement board product having a clear embossing pattern in the upper surface and an uniform density. Briefly, said objects of the present invention can be attained by a method of manufacturing wood-cement board comprising strewing a raw materials mixture of wood-cement board on a mold panel to form a mat, piling up a plural number of said mats with said mold panels, pre-pressing said piled mats to reduce the thickness of each mat, piling up a plural number of said pre-pressed mats, main-pressing said pre-pressed and piled mats and curing said piled mats being main-pressed and a preferable pre-press machine used in said method consists of piling up machine piling up a plural number of mats formed on a mold panel, a pre-press machine pre-pressing said piled mats to reduce the thickness of each mat, a main-piling up machine piling up a plural number of said pre-pressed mats, a main-pressing machine main-pressing said pre-pressed and piled mats, and a curing chamber curing said piled mats being main-pressed.

BRIEF DESCRIPTION OF THE DRAWINGS

FIG. 1 is a process chart of a method of manufacturing wood cement board.

FIG. 2 is a side view of a piling up machine used in said method when elevating panel is located at the lowest position.

FIG. 3 is a front sectional view of said piling up machine when elevating panel is located at the lowest position.

FIG. 4 is a front sectional view of said piling up machine when elevating panel is located at the highest position.

FIG. 5 is a front sectional view of said piling up machine when hanging bars is located in the middle position.

FIG. 6 is a side view of a pre-press machine used in said method when an upper plate is located at the highest position.

FIG. 7 is a front sectional view of said pre-press machine when the upper plate is located at the highest position.

FIG. 8 is a side view of said pre-press machine when the upper plate is located at the lowest position.

FIG. 9 is a side view of said pre-press machine when the upper plate start to ascend peeling off the film from the mat.

DETAILED DESCRIPTION

Figure 1:
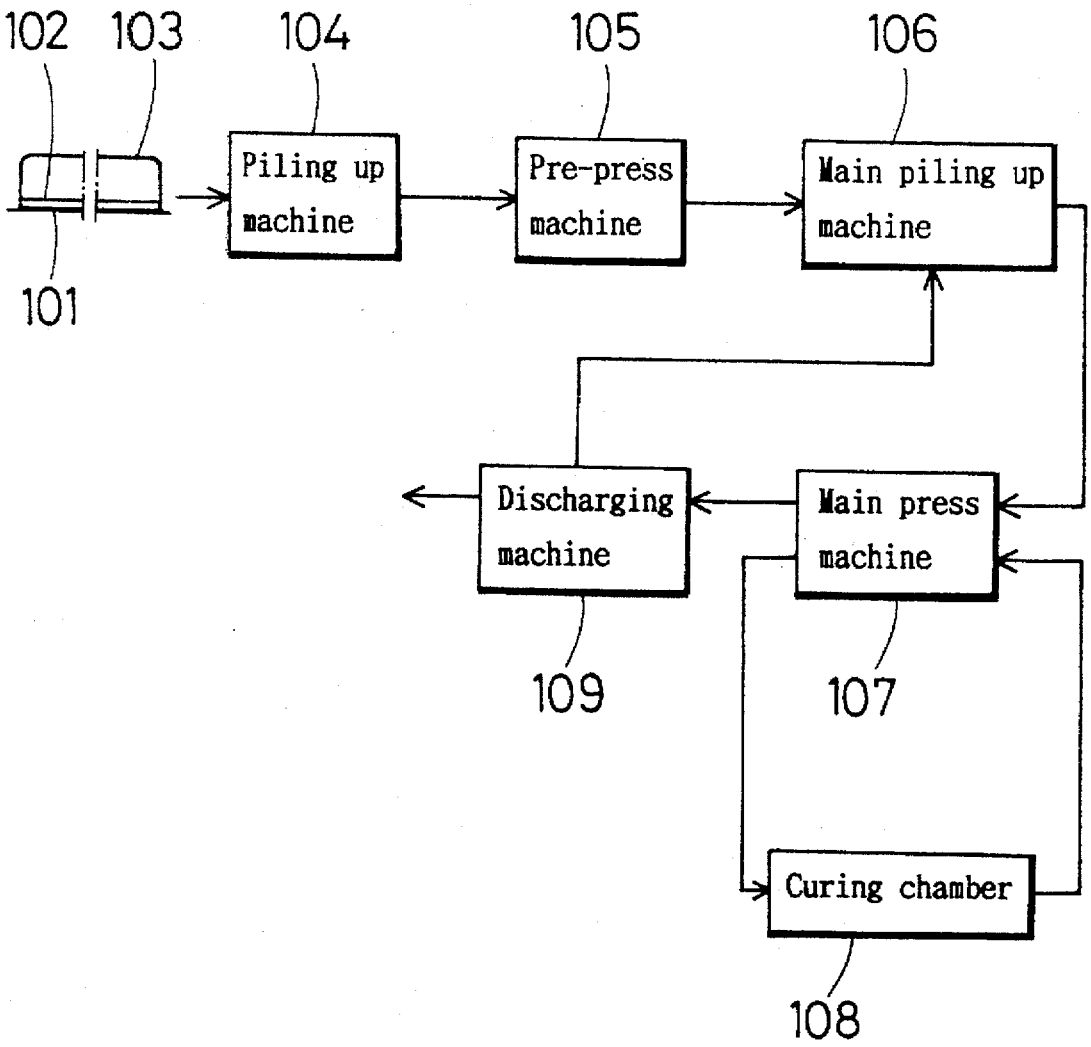
FIG. 1 to FIG. 9 relate to an embodiment of the present invention.
Figure 2:
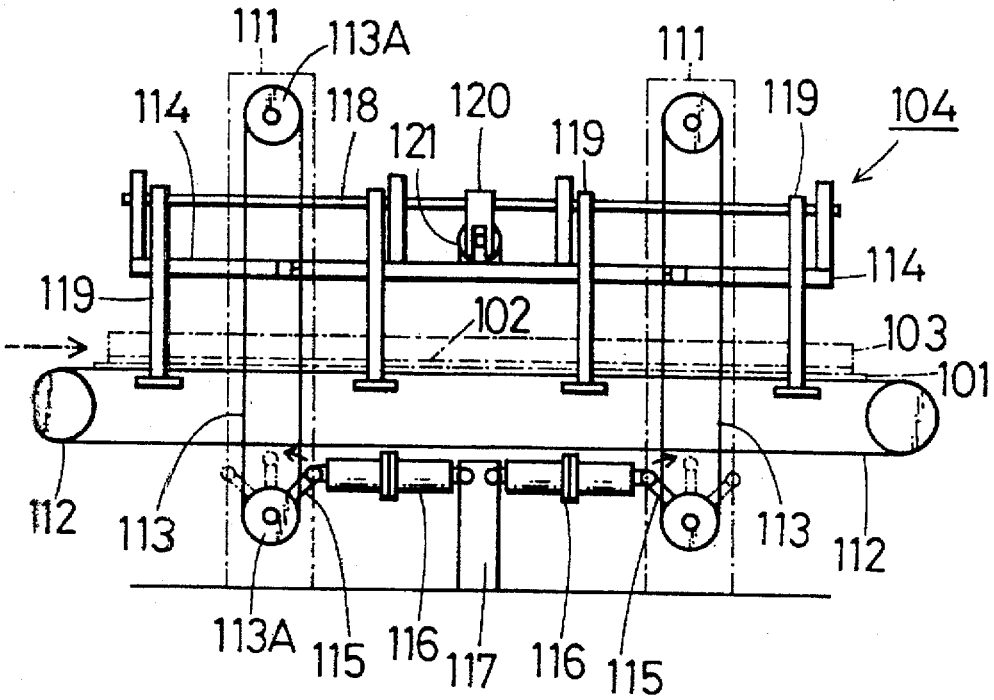

FIG. 1 to FIG. 9 relate to an embodiment of the present invention. Referring now to FIG. 1, a mold panel (102) having an embossed mold surface is put on a conveyer panel (101) and a raw materials mixture is strewed on said mold panel (102) to form a mat (103). Said raw materials mixture may consist of cement such as Portland cement, blast furnace cement, fly ash cement, silica cement, alumina cement, and the like, reinforcing wood material such a der, wood flake, wood pulp, wood fiber, bundled wood fiber, bamboo fiber, hemp fiber, palm fiber, bagasse, rice straw, wheat straw chaff and the like, aggregate such as silica sand, silica powder, silica fume, silas balloon, pearlite, expansive shale, expansive clay, burned diatomaceous earth, fly ash, blast furnace slag, gypsum powder, sludge ash, coal cinders and the like. And commonly said mixture may contain 40 to 60% by weight of the water. Commonly the thickness of said mat (103) may be 100 to 150 mm. Said mat (103) is then sent to a piling up machine (104) by said conveyer panel (101) and a plural number of said mats (103) are piled up by said piling up machine (104) with said mold panels (102). Preferably 2 to 4 mats (103) are piled and when more than 5 mats (104) are piled, piled mats may become unstable because said mat (103) is soft.

Said piled mats (103) are then sent to a pre-press machine (105) by said conveyer panel (101) and said piled mats (103) are pre-pressed with said mold panels (102) to reduce the thickness of each mat (103). Commonly the pressure applied in said pre-press process may be 1 to 2 kgf/cm$^2$ and the press time may be 1 to 5 seconds. Commonly the thickness of each mat (103) is reduced to about 50%.

Said pre-pressed mats (103) are then sent to a main piling up machine (106) with said mold panels (102). Scores of mats (103), commonly 40 to 70 mats (103), are piled by said main piling up machine (106) and said piled pre-pressed mats (103) are sent to a main press machine (107) to be main-pressed. During said main-press process, the surface of each mat (103) is embossed by the embossed surface of each mold panel (102). After said main-press process, the pressure effecting to each mat (103) is released and then said piled mats (103) are sent to a curing chamber (108) for curing. Said cured mats (103) are then preferably sent to said main-press machine (107) again and said cured mats (103) are a little pressed (after-pressed). After said after-press, said piled after-pressed mats (103) (wood-cement board products) are removed from said main-press machine (107) and sent to a discharging machine (109) to be discharged and removed from said mold panel (102) and conveyer panel (101). A resulting wood-cement board has the thickness of about 20 mm and embossed surface and said wood-cement board may be used as a siding.

As shown in FIG. 2 to FIG. 5, said piling up machine (104) consists of vertical frames (111) arranged before and behind, and right and left, a conveyer (112) arranged between said vertical frames (111), a vertical endless chain (113) hanged between a pair of sprockets (113A)(113A) supported rotatably on each vertical frame (111), an elevating panel (114) supported by said vertical endless chain (113) and arranged upon said conveyer (112), a plural number of hanging bars (119) supported by side frames (118) of said elevating panel (114), a click (119A) formed at the lower end of each hanging bars (119), air cylinders (121) supported on said elevating panel (114) and connecting to arms (120) extended from the upper end of said hanging bars (119), and double air cylinders (116) connecting to arms (115) extended from the axis of said sprockets (113A).

Figure 3:
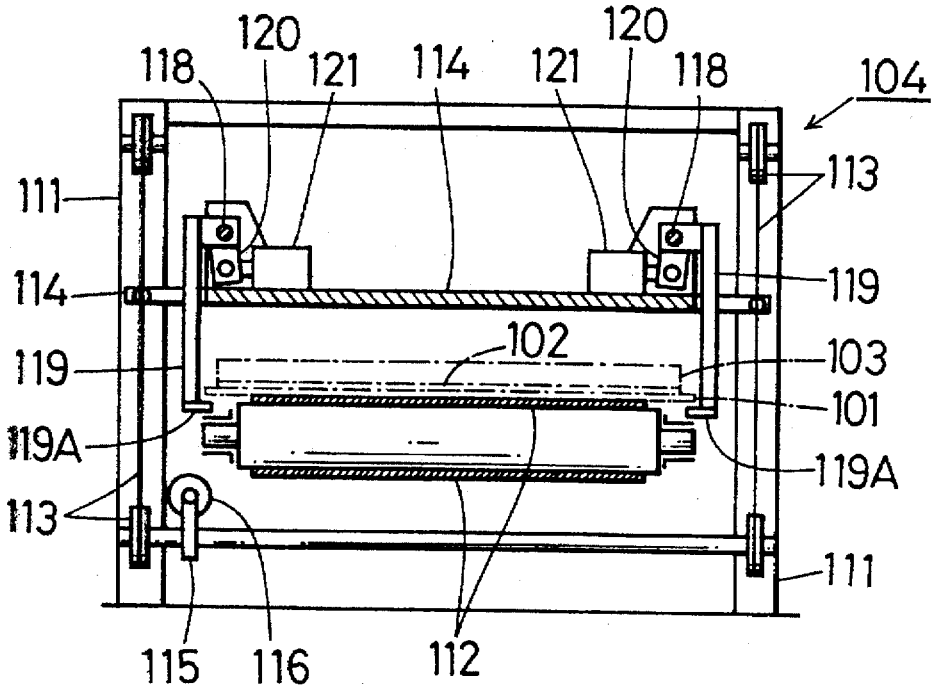
Figure 4:
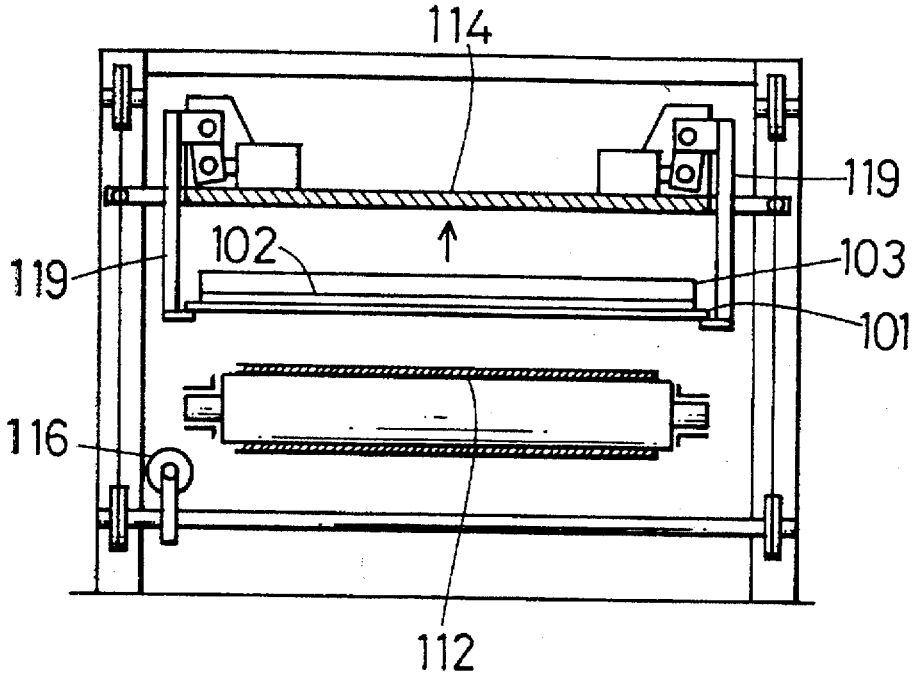
Figure 5:
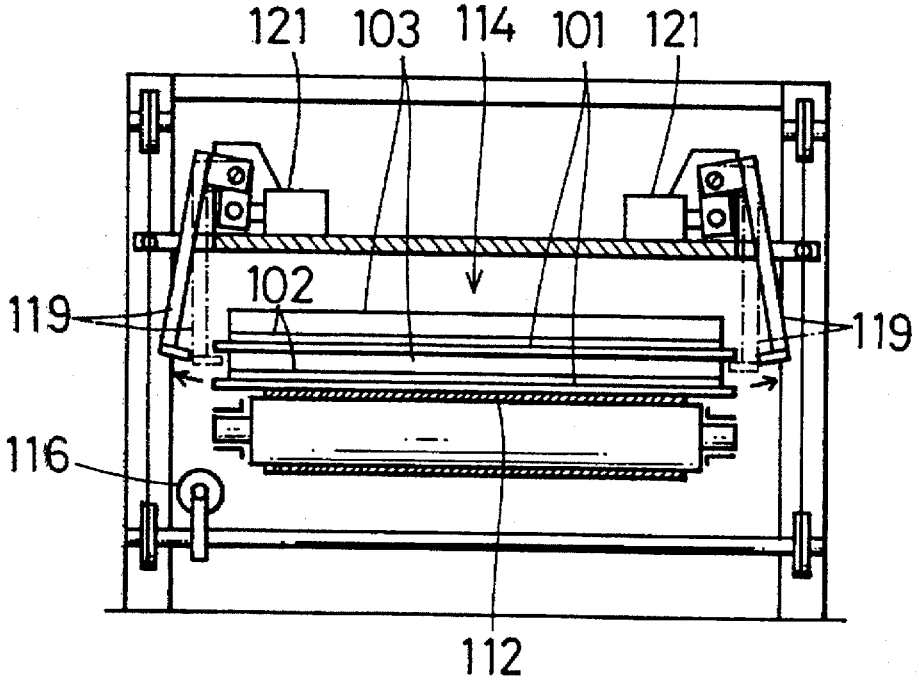
Figure 6:
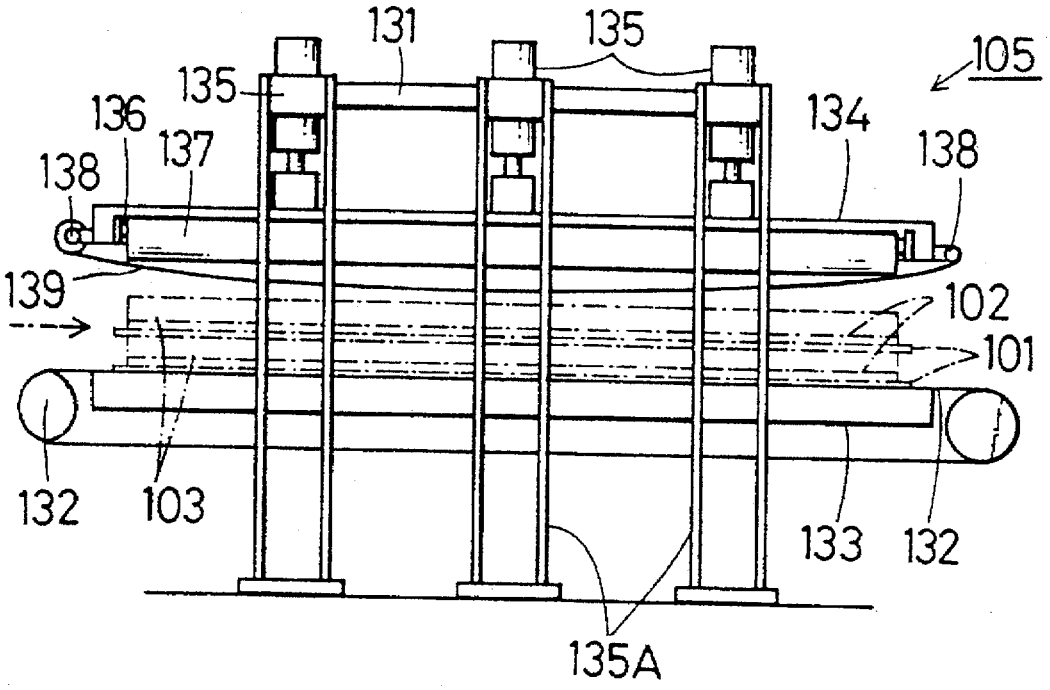
Figure 7:
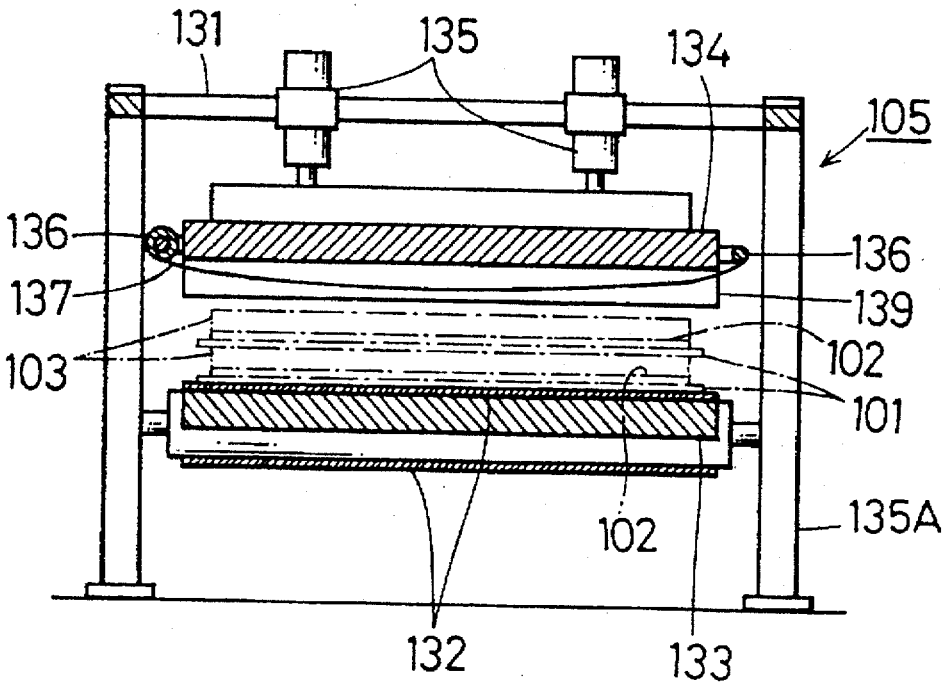
Figure 8:
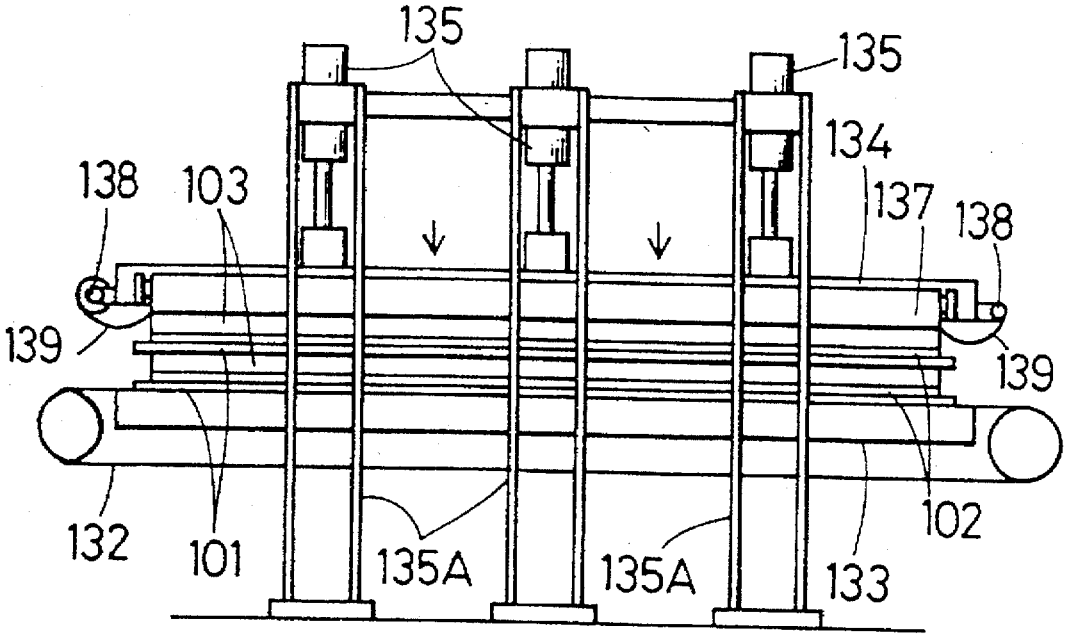

When said mat (103) formed on said mold panel (102) has been sent to said piling up machine (104) by said conveyer (112) with said conveyer panel (101), said elevating panel (114) is located at the lowest position as shown in FIG. 3 and said hanging bars (119) are respectively in vertical position (close state) and each click (119A) of each hanging bars (119) is located underside of said conveyer panel (101). After that said elevating panel (114) is ascended to the highest position by operating said double air cylinders (116) with said hanging bars (119) to raise said conveyer panel (101) with said mat (103) from said conveyer (112) as shown in FIG. 4 followed by operating said conveyer (112) to send another mat (103) on said mold panel (102) with said conveyer panel (101) under said raised conveyer panel (101). When another mat (103) has been sent under said raised conveyer panel (101), said double air cylinders (116) are operated again to lower said elevating panel (114) to the middle position as shown in FIG. 5 to pile up said mat (103) with said mold panel (102) and said conveyer panel (101) on another mat (103).

After a pair of mats (103) are piled up respectively, each hanging bar (119) is inclined to outside (open state) by operating said air cylinder (121) to release each click (119A) of each hanging bar (119) from said conveyer panel (101). As above described a plural number of mats (103) are piled up before the pre-press process.

As shown in FIG. 6 to FIG. 9, said pre-press machine (105) consists of a lower plate (133), an upper plate (134), a plural number of hydraulic cylinder (135) supported by a plural number of vertical frame (135A) and connecting to the upper side of said upper plate (134) respectively and a conveyer (132) arranged between said lower plate (133) and said upper plate (134) wherein a fiber sheet (137) is sagged on right and left under said upper plate (134) and a plastic sheet (139) is sagged before and behind under said fiber sheet (137) and one end of said fiber sheet (137) is rolled on a bar (136) attached to right or left side of said upper plate (134) and the other end of said fiber sheet (137) is drawn out from said rolled fiber sheet (137) and fixed to the other bar (136) attached to left or right side of said upper plate (134), and further one end of said plastic sheet (139) is rolled on a bar (138) attached to front or rear side of said upper plate (134) and the other end of said plastic sheet (139) is drawn out from said rolled plastic sheet (139) and fixed to the other bar (138) attached to rear or front side of said upper plate (134).

Said fiber sheet (137) may be made of cloth or nonwoven fabric and said plastic sheet (139) may be made of polyethylene, polytetrafluoroethylene, polyvinylchloride, and the like and the thickness of said plastic sheet (139) may be 30 to 50 μm.

When said piled mats (103) have been sent to said pre-press machine (105) with said mold panel (102) and said conveyer panel (101) by said conveyer (132), said hydraulic cylinders (135) start to be operated to push down said upper plate (134) and said piled mats (103) are pre-pressed between said upper plate (134) and said lower plate (133) to reduce the thickness of each mat (103).

Figure 9:
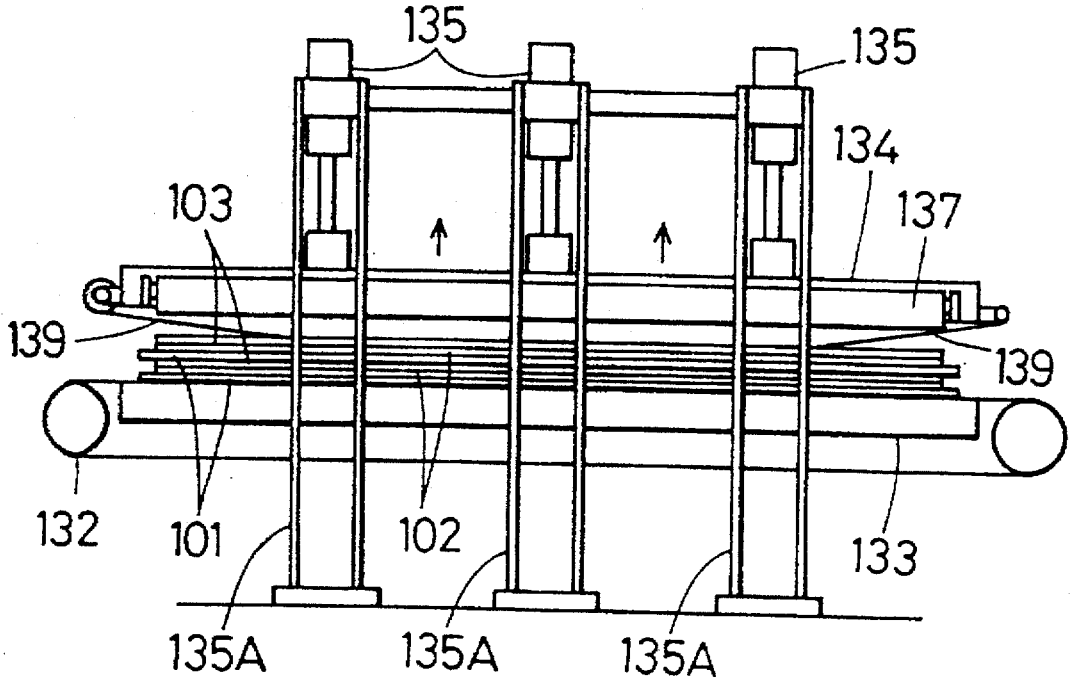

After said pre-press, said upper plate (134) starts to ascend by operating said hydraulic cylinders (135), first the front and rear ends of said plastic sheet (139) may be separated from upper-most mat (103) and then the middle of said plastic sheet (139) may be separated from said upper most mat (103) as shown in FIG. 9.

When said upper plate (134) ascends to be separated from said upper most mat (103) as above described and release pressure effecting on said piled mats (103), preferably the operation of said hydraulic cylinders (135) is suspended in a moment to stop temporarily ascension of said upper plate (134). When said ascending upper plate (134) temporarily stops, the distance between said upper plate (134) and said upper-most mat (103) may be 10 to 30 mm.

Since a plural number of said mats (103) are piled up in said pre-press process, a plural number of said mats (103) are pre-pressed at the same time so that pre-press time is saved in the present invention and said upper plate (134) can be ascended slowly after pre-press to avoid the generation of big negative pressure between said upper plate (134) and upper-most mat (103), and said conveyer panel (101) of upper mat (103) and lower mat (103).

As above described, since said plastic sheet (139) is separated from the front and rear ends of said upper-most mat (103), the generation of big negative pressure between said upper plate (134) and said upper-most mat (103) can be certainly avoided and further when ascension of said upper plate (134) is temporarily stopped, the negative pressure between said upper plate (134) and said upper-most mat (103) may be much more reduced.

Said fiber sheet (137) prevents said plastic sheet (139) from adhering to said upper plate (134) during the pre-press press and when said fiber sheet (137) is broken, new part of said fiber sheet (137) is drawn out from said rolled fiber sheet (137). When said plastic sheet (139) is broken, new part of said plastic sheet (139) is drawn out from said rolled plastic sheet (139). Nevertheless, if said plastic sheet (139) does not adhere to said upper plate (134), said fiber sheet (137) is not necessary.

As above described when the pressure of said pre-press is released, the generation of big negative pressure between said upper plate (134) and said upper most mat (103), and said conveyer panel (101) of upper mat (103) and lower mat (103) is prevented in the present invention, so that the cloud of the raw material does not rise from the upper surface of each mat (103) to obtain an even upper surface of each mat (103).

Said main press machine (107) consists of an upper plate and a lower plate the same as said pre-press machine (105), and said lower plate is sent to said main piling up machine (106) and a plural number of pre-pressed mats (103) are piled up with said mold panel (102) and said conveyer panel (101) on said lower plate of said main press machine (107) and then said lower plate is sent to said main-press machine (107). After main-press process, piled and main-pressed mats (103) are sent to said curing chamber (108) with said lower plate and after curing said piled and cured mats (103) are preferably sent to said main-press machine (107) again with said lower plate for after press. After said after-press, said after-pressed mats (103) (wood-cement board products) are sent to said discharging machine (109) with said lower plate. After wood-cement board products are discharged from said lower plate, said lower plate is sent to said main piling up machine (106) again.

We claim:

1. A method of manufacturing wood-cement board comprising strewing a raw materials mixture of wood-cement board on a mold panel to form a mat, piling up a plural number of said mold panels having said mats thereon, pre-pressing said piled mats and panels to reduce the thickness of each mat, piling up a plural number of said pre-pressed mats and panels; main-pressing said pre-pressed and piled mats and panels and curing said piled, main-pressed mats.

2. A method of manufacturing wood-cement board in accordance with claim 1, wherein said cured mats are after-pressed.

3. A method of manufacturing wood-cement board in accordance with claim 1, wherein said piled mats are pre-pressed between an upper plate and a lower plate of a pre-press machine and when said upper plate is ascended after said pre-press to be separated from upper most mat, said upper plate is temporarily stopped.

4. A method of manufacturing wood-cement board in accordance with claim 1, wherein 2 to 4 mats are piled up before said pre-pressing.

* * * * *